US006082945A

United States Patent [19]

Jeffries et al.

[11] Patent Number: 6,082,945

[45] Date of Patent: Jul. 4, 2000

[54] SHEET MATERIAL LIFTING AND RETAINING APPARATUS

[76] Inventors: Rick Jeffries, P.O. Box 1105, Marion, Mont. 59925; Mark McCully, 305 California Ave., Libby, Mont. 59923

[21] Appl. No.: 09/299,842

[22] Filed: Apr. 26, 1999

[51] Int. Cl.[7] ..... E04G 21/16

[52] U.S. Cl. ..... 414/11; 248/354.1; 414/800

[58] Field of Search ..... 248/354.1, 354.5, 248/615, 616; 414/11, 800

[56] References Cited

U.S. PATENT DOCUMENTS

| | | | |
|---|---|---|---|
| 4,027,802 | 6/1977 | Reynolds | 414/11 |
| 4,531,720 | 7/1985 | Söder | 414/11 X |
| 4,576,354 | 3/1986 | Blessing, Sr. | 248/354.5 |
| 4,733,844 | 3/1988 | Molloy | 414/11 X |
| 4,838,527 | 6/1989 | Holley | 267/64.28 |
| 5,129,774 | 7/1992 | Balseiro et al. | 414/11 |
| 5,224,808 | 7/1993 | Macris | 414/11 |
| 5,322,403 | 6/1994 | Herde | 414/11 |
| 5,636,383 | 6/1997 | Cwiakala | 2/171 |
| 5,658,124 | 8/1997 | Presnell, III | 414/11 X |
| 5,732,527 | 3/1998 | Schneider | 52/49.1 |

FOREIGN PATENT DOCUMENTS

| | | | |
|---|---|---|---|
| 2-89800 | 3/1990 | Japan | 414/11 |

*Primary Examiner*—Janice L. Krizek
*Attorney, Agent, or Firm*—Burkhart & Burkhart; Anne K. Burkhart; Patrick N. Burkhart

[57] ABSTRACT

A sheet material lifting and retaining apparatus including a shaft member having a longitudinal axis is described. A gas cylinder assembly is secured to the shaft member, the gas cylinder assembly having an axis of operation that is generally coaxial with the longitudinal axis of the shaft member. A sheet material contact member is secured to the gas cylinder assembly. The shaft member can include a length adjustment mechanism, which may be provided as a telescoping tube arrangement having a plurality of telescoping aluminum tubes. The gas cylinder assembly can include a self-contained gas cylinder. An end fitting can be secured to a first end of the gas cylinder, with a shaft attachment member secured to a second, opposite end of the gas cylinder. An actuator can be provided to selectively control actuation of the gas cylinder. The actuator of the gas cylinder assembly can include a rod portion extending generally parallel to the shaft member. The shaft member can include an attachment bracket adapted to be secured to the shaft attachment member of the gas cylinder assembly. The end fitting can be adapted to be secured to the sheet material contact member, which may be provided as a generally planar nylon block. A floor contact member, which may include a cushion contact surface, can secured to an end of the shaft member opposite the gas cylinder assembly.

20 Claims, 1 Drawing Sheet

SHEET MATERIAL LIFTING AND RETAINING APPARATUS

CROSS-REFERENCE TO RELATED APPLICATIONS

None

STATEMENT AS TO RIGHTS TO INVENTIONS MADE UNDER FEDERALLY-SPONSORED RESEARCH AND DEVELOPMENT

None

FIELD OF THE INVENTION

The invention relates generally to construction apparatus. In particular, the invention relates to methods and apparatus for assisting in elevating and retaining in place relatively large units of sheet material during overhead construction.

DESCRIPTION OF RELATED ART

The development of wall panel construction involving materials such as "sheet rock" or "drywall" has revolutionized the construction industry. Prior to the emergence of such materials, it was common for the interior walls and ceilings of buildings to be constructed of plaster applied over wood lathes, a construction method that was both demanding and time-consuming. Panel construction, while still requiring a degree of skill, significantly reduced the amount of time required to complete interiors.

The installation of panel materials to overhead ceiling surfaces has proven problematic. It is common for one or more workers to manually lift the panels of sheet material into an intended overhead placement location, then hold the sheet material in place while other workers secure the sheet material to its support structure, typically using fasteners such as screws. This process is labor-intensive, and poses a risk of injury to the workers involved.

Not surprisingly, the lifting and retaining of sheet materials in such situations has been the subject of a high degree of inventive activity. For example, U.S. Pat. No. 4,576,354 to Blessing is directed to a panel overhead support apparatus including a column having a bearing plate and a compression spring. The support column is adjusted to a length greater than the floor-to-ceiling height, the spring is compressed, and the support column is placed under the panel. The compression spring is then allowed to expand, thus supporting the panel in place.

U.S. Pat. No. 4,733,844 to Molloy describes a sheet rock support arrangement in which a dutch is used to manually adjust a compression spring to support an overhead panel.

U.S. Pat. No. 5,129,774 to Balseiro shows a sheet rock lifter using a compressible bar spring to support an overhead panel.

U.S. Pat. No. 5,322,403 to Herde is directed to a panel support lift including telescoping tubular members damped by an air piston.

U.S. Pat. No. 5,636,383 to Cwiakala discloses a head-mounted apparatus for supporting and raising ceiling materials.

U.S. Pat. No. 5,732,527 to Schneider is directed to a pivoting panel lift apparatus that is secured to the ceiling support structure. A ceiling panel is placed on a downwardly-angled ramp, then a gas cylinder causes the ramp to lift the panel into a substantially horizontal orientation adjacent the ceiling joists.

Each of these apparatus is relatively complicated, or requires physical operation that offers only a slight advantage over merely lifting the panels into place manually.

It can be seen from the foregoing that the need exists for a simple, automatic mechanism for assisting in elevating and retaining in place relatively large units of sheet material during overhead construction

SUMMARY

These and other objects are achieved by providing a sheet material lifting and retaining apparatus including a shaft member having a longitudinal axis. A gas cylinder assembly is secured to the shaft member, the gas cylinder assembly having an axis of operation that is generally coaxial with the longitudinal axis of the shaft member. A sheet material contact member is secured to the gas cylinder assembly.

The shaft member can include a length adjustment mechanism, which may be provided as a telescoping tube arrangement having a plurality of telescoping aluminum tubes.

The gas cylinder assembly can include a self-contained gas cylinder. An end fitting can be secured to a first end of the gas cylinder, with a shaft attachment member secured to a second, opposite end of the gas cylinder. An actuator can be provided to selectively control actuation of the gas cylinder. The actuator of the gas cylinder assembly can include a rod portion extending generally parallel to the shaft member.

The shaft member can include an attachment bracket adapted to be secured to the shaft attachment member of gas cylinder assembly. The end fitting can be adapted to be secured to the sheet material contact member, which may be provided as a generally planar nylon block.

A floor contact member, which may include a cushion contact surface, can secured to an end of the shaft member opposite the gas cylinder assembly.

The features of the invention believed to be patentable are set forth with particularity in the appended claims. The invention itself, however, both as to organization and method of operation, together with further objects and advantages thereof, may be best understood by reference to the following description taken in conjunction with the accompanying drawings.

DETAILED DESCRIPTION OF A PREFERRED EMBODIMENT

Figure 1:
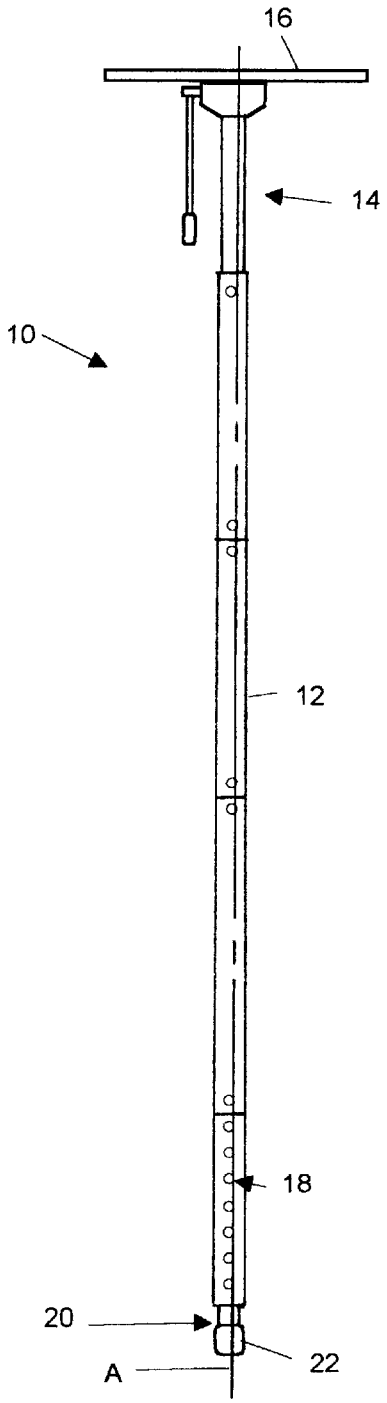
FIG. 1 is a schematic elevational view of a sheet material lifting and retaining apparatus in accordance with the principles of the present invention.

While this invention is susceptible of embodiment in many different forms, there is shown in the drawings, and will herein be described in detail, exemplary embodiments, with the understanding that the present disclosure is to be considered as illustrative of the principles of the invention and not intended to limit the invention to the exemplary embodiments shown and described.

A sheet material lifting and retaining apparatus 10 is illustrated in FIG. 1. The apparatus 10 includes a shaft member 12 having a longitudinal axis A. A gas cylinder assembly 14 is secured to the shaft member. The gas cylinder assembly 14 has an axis of operation (arrow O in FIG. 2) that is generally coaxial with the longitudinal axis A of the shaft member 12. A sheet material contact member 16 is secured to the gas cylinder assembly 14. The sheet material contact member 16 can be fabricated from any suitable material, depending on the nature of the sheet material to be lifted and retained. In applications involving sheet rock, it has been found that configuring the sheet material contact member 16 as a generally planar nylon block is particularly advantageous.

The shaft member 12 includes a suitable length adjustment mechanism 18. The mechanism 18 may, for example, be provided as a telescoping tube arrangement having a plurality of telescoping 1.5" diameter aluminum tubes connected in a conventional spring-pin and aperture arrangement as illustrated.

A floor contact member 20, which may include a cushion contact surface 22, can be secured to an end of the shaft member 12 opposite the gas cylinder assembly 14.

Figure 2:
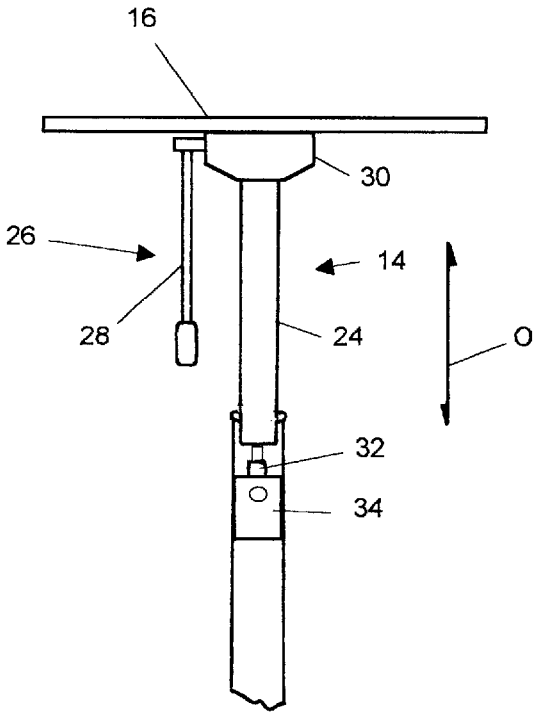
FIG. 2 schematically illustrates a detailed view, partially broken away, of a sheet material lifting and retaining apparatus as shown in FIG. 1.

As shown in FIG. 2, the gas cylinder assembly 14 includes a self-contained gas cylinder 24. Although any suitable gas cylinder can be provided, one example of which is model TYP 17-04-19 manufactured by SUSPA, Inc. of Grand Rapids, Mich. An actuator 26 can be provided to selectively control actuation of the gas cylinder 24. The actuator 26 includes a rod portion 28 extending generally parallel to the shaft member 12. An end fitting 30 can be secured to a first end of the gas cylinder 24. In the illustrated example, the end fitting is also a stock item manufactured by SUSPA, Inc.

A shaft attachment member 32 is secured to a second, opposite end of the gas cylinder 24. The shaft member 12 includes an attachment bracket 34 adapted to be secured to the shaft attachment member 32.

In operation, a unit of sheet material is placed in proximity to an intended overhead placement location. The sheet material lifting and retaining apparatus 10, with the shaft member 12 adjusted to a length slightly less than the floor to ceiling height, is then positioned beneath and in contact with the unit of sheet material. The gas cylinder assembly 14 is then actuated to extend outwardly along the direction of arrow O to lift the unit of sheet material into the intended overhead placement location. The sheet material lifting and retaining apparatus 10 can then be allowed to remain in place to retain the unit of sheet material in the intended overhead placement location while workers fasten the panel into place.

While details of the invention are discussed herein with reference to some specific examples to which the principles of the present invention can be applied, the applicability of the invention to other devices and equivalent components thereof will become readily apparent to those of skill in the art.

Accordingly, it is intended that all such alternatives, modifications, permutations, and variations to the exemplary embodiments can be made without departing from the scope and spirit of the present invention.

We claim:

1. A sheet material lifting and retaining apparatus comprising the following:

a shaft member having a longitudinal axis;

a self-contained gas cylinder assembly secured to the shaft member, the gas cylinder assembly including a pre-charged, self-contained gas spring having an axis of operation that is generally coaxial with the longitudinal axis of the shaft member; and a sheet material contact member secured to the self-contained gas cylinder assembly;

whereby actuation of the gas cylinder assembly facilitates lifting and retention of the unit of sheet material into an overhead placement location.

2. A sheet material lifting and retaining apparatus according to claim 1, wherein the shaft member comprises a length adjustment mechanism.

3. A sheet material lifting and retaining apparatus according to claim 2, wherein the length adjustment mechanism of the shaft member comprises a telescoping tube arrangement.

4. A sheet material lifting and retaining mechanism according to claim 3, wherein the shaft member comprises a plurality of telescoping aluminum tubes.

5. A sheet material lifting and retaining apparatus according to claim 1, wherein the self-contained gas cylinder assembly comprises the following:

a self-contained gas cylinder;

an end fitting secured to a first end of the self-contained gas cylinder;

a shaft attachment member secured to a second, opposite end of the self-contained gas cylinder; and an actuator adapted to selectively control actuation of the self-contained gas cylinder.

6. A sheet material lifting and retaining apparatus according to claim 5, wherein the actuator of the self-contained gas cylinder assembly comprises a rod portion extending generally parallel to the shaft member.

7. A sheet material lifting and retaining apparatus according to claim 5, wherein the shaft member includes an attachment bracket adapted to be secured to the shaft attachment member of the self-contained gas cylinder assembly.

8. A sheet material lifting and retaining apparatus according to claim 5, wherein the end fitting is adapted to be secured to the sheet material contact member.

9. A sheet material lifting and retaining apparatus according to claim 1, wherein the sheet material contact member comprises a generally planar nylon block.

10. A sheet material lifting and retaining apparatus according to claim 1, further comprising a floor contact member secured to an end of the shaft member opposite the self-contained gas cylinder assembly.

11. A sheet material lifting and retaining apparatus according to claim 10, wherein the floor contact member comprises a cushion contact surface.

12. A sheet material lifting and retaining apparatus comprising the following:

an adjustable-length shaft member having a longitudinal axis;

a self-contained, selectively-actuable gas cylinder assembly secured to the shaft member, the self-contained gas cylinder assembly including a pre-charged, self-contained gas spring having an axis of operation that is generally coaxial with the longitudinal axis of the shaft member; and a sheet material contact member secured to the self-contained gas cylinder assembly;

whereby actuation of the gas cylinder assembly facilitates lifting and retention of the unit of sheet material into an overhead placement location.

13. A sheet material lifting and retaining apparatus according to claim 12, wherein the shaft member comprises a length adjustment mechanism including a telescoping tube arrangement.

14. A sheet material lifting and retaining mechanism according to claim 13, wherein the shaft member comprises a plurality of telescoping aluminum tubes.

15. A sheet material lifting and retaining apparatus according to claim 12, wherein the self-contained gas cylinder assembly comprises the following:

a self-contained gas cylinder;

an end fitting secured to a first end of the self-contained gas cylinder;

a shaft attachment member secured to a second, opposite end of the self-contained gas cylinder; and an actuator adapted to selectively control actuation of the self-contained gas cylinder.

16. A sheet material lifting and retaining apparatus according to claim 15, wherein the actuator of the self-contained gas cylinder assembly comprises a rod portion extending generally parallel to the shaft member.

17. A sheet material lifting and retaining apparatus according to claim 15, wherein the shaft member includes an attachment bracket adapted to be secured to the shaft attachment member of the self-contained gas cylinder assembly.

18. A sheet material lifting and retaining apparatus according to claim 15, wherein the end fitting is adapted to be secured to the sheet material contact member.

19. A sheet material lifting and retaining apparatus according to claim 1, further comprising a floor contact member secured to an end of the shaft member opposite the self-contained gas cylinder assembly.

20. A method of lifting and retaining sheet material, the method comprising the following steps:

providing a sheet material lifting and retaining apparatus including a shaft member having a longitudinal axis, a selectively-actuable self-contained gas cylinder assembly secured to the shaft member, the self-contained gas cylinder assembly including a pre-charged, self-contained gas spring having an axis of operation that is generally coaxial with the longitudinal axis of the shaft member, and a sheet material contact member secured to the self-contained gas cylinder assembly;

placing a unit of sheet material in proximity to an intended overhead placement location;

placing the sheet material lifting and retaining apparatus beneath and in contact with the unit of sheet material;

actuating the self-contained gas cylinder assembly of the sheet material lifting and retaining apparatus to lift the unit of sheet material into the intended overhead placement location; and allowing the sheet material lifting and retaining apparatus to remain in place to retain the unit of sheet material in the intended overhead placement location.

* * * * *

UNITED STATES PATENT AND TRADEMARK OFFICE

CERTIFICATE OF CORRECTION

PATENT NO. : 6,082,945

DATED : Jul. 4 2000

INVENTOR(S) : Jeffries et al.

It is certified that error appears in the above-identified patent and that said Letters Patent is hereby corrected as shown below:

column 1, line 50, delete "dutch" and insert --clutch-- in its place.

Signed and Sealed this

First Day of May, 2001

Nicholas P. Godici

*Attest:*

NICHOLAS P. GODICI

*Attesting Officer*

*Acting Director of the United States Patent and Trademark Office*